US009714116B2

(12) United States Patent
Rader et al.

(10) Patent No.: US 9,714,116 B2
(45) Date of Patent: Jul. 25, 2017

(54) TWO-COMPONENT PALLET

(71) Applicant: Monoflo International, Inc., Winchester, VA (US)

(72) Inventors: Henning Rader, Middleburg, VA (US); Axel Sommer, Tacoma, WA (US); Bryan S. Ritchie, Clear Brook, VA (US)

(73) Assignee: MONOFLO INTERNATIONAL, INC., Winchester, VA (US)

( * ) Notice: Subject to any disclaimer, the term of this patent is extended or adjusted under 35 U.S.C. 154(b) by 0 days.

(21) Appl. No.: 15/092,214

(22) Filed: Apr. 6, 2016

(65) Prior Publication Data

US 2016/0288951 A1 Oct. 6, 2016

Related U.S. Application Data

(60) Provisional application No. 62/143,311, filed on Apr. 6, 2015.

(51) Int. Cl.
*B65D 19/00* (2006.01)

(52) U.S. Cl.
CPC ..... *B65D 19/0016* (2013.01); *B65D 2519/00034* (2013.01); *B65D 2519/00069* (2013.01); *B65D 2519/00273* (2013.01); *B65D 2519/00288* (2013.01); *B65D 2519/00308* (2013.01); *B65D 2519/00318* (2013.01); *B65D 2519/00333* (2013.01); *B65D 2519/00402* (2013.01); *B65D 2519/00407* (2013.01); *B65D 2519/00562* (2013.01); *B65D 2519/00567* (2013.01)

(58) Field of Classification Search
CPC ..... B65D 2519/00069; B65D 2519/00104; B65D 2519/00034; B65D 2519/00552; B65D 2519/00562; B65D 2519/00567
USPC ..... 108/901, 902, 56.1, 56.3, 57.25–57.27, 108/57.33
See application file for complete search history.

(56) References Cited

U.S. PATENT DOCUMENTS

| | | | | |
|---|---|---|---|---|
| 4,316,419 | A * | 2/1982 | Cupido | B65D 19/0012 108/56.1 |
| 4,323,016 | A | 4/1982 | Flesher et al. | |
| 4,403,555 | A * | 9/1983 | Forrest | B65D 19/0012 108/57.26 |
| 4,597,339 | A | 7/1986 | McCaffrey et al. | |
| 5,483,899 | A * | 1/1996 | Christie | B65D 19/0073 108/56.3 |
| 5,520,121 | A | 5/1996 | Schubart et al. | |
| 5,967,057 | A * | 10/1999 | Nakayama | B29C 45/1704 108/57.25 |
| 6,237,509 | B1 | 5/2001 | Ishido et al. | |
| 7,182,026 | B2 | 2/2007 | Birkenmayer | |
| 7,779,764 | B2 * | 8/2010 | Naidu | B65D 19/0095 108/56.1 |

(Continued)

*Primary Examiner* — Janet M Wilkens
(74) *Attorney, Agent, or Firm* — Nixon & Vanderhye P.C.

(57) ABSTRACT

A two-component pallet includes an upper part defining a deck and including a plurality of posts, and a lower part including a corresponding plurality of feet arranged in complement with the posts. The posts and the feet each include an alignment member and ribs. The upper part is welded to the lower part such that the ribs are welded together. The alignment member of the posts is engaged with the alignment member of the feet without being welded. In some embodiments, the ribs are bent to better absorb impact from a forklift tine or the like.

17 Claims, 9 Drawing Sheets

(56) References Cited

U.S. PATENT DOCUMENTS

| | | | | |
|---|---|---|---|---|
| 8,434,618 | B2 * | 5/2013 | Mitchell | B65D 19/06 108/56.3 |
| 8,584,599 | B2 * | 11/2013 | Sosa Bravo | B65D 19/0038 108/56.3 |
| 8,739,706 | B2 | 6/2014 | Dubois et al. | |
| 8,950,342 | B2 * | 2/2015 | Plattner | B65D 19/0016 108/56.3 |
| 2006/0032413 | A1 * | 2/2006 | Ogburn | B65D 19/0012 108/57.25 |
| 2008/0236455 | A1 * | 10/2008 | Naidu | B65D 19/0038 108/56.1 |

* cited by examiner

TWO-COMPONENT PALLET

CROSS-REFERENCES TO RELATED APPLICATIONS

This application claims the benefit of U.S. Provisional Patent Application No. 62/143,311, filed Apr. 6, 2015, the entire content of which is herein incorporated by reference.

STATEMENT REGARDING FEDERALLY SPONSORED RESEARCH OR DEVELOPMENT (Not Applicable)

BACKGROUND OF THE INVENTION

The invention relates to a two-component pallet and, more particularly, to a two-component pallet including upper and lower parts with alignment features and modified internal structure to better accommodate impact.

It is desirable to increase the impact resistance of a welded pallet foot. In use, plastic molded pallets support stacks of product and are typically moved using a forklift. It is not uncommon for a forklift operator to impact the side of the pallets with the tines of the forklift. Improving the impact resistance of a welded pallet foot will expand the useful life of the pallet.

BRIEF SUMMARY OF THE INVENTION

In some embodiments, the pallet may have an upper part (deck) and a lower part (feet with runners). The parts are bonded by hotplate welding. The upper part and lower part include alignment features and inner ribs, where the geometry of the upper part engages the geometry of the lower part or vice versa. Such engagements create a positive interlock, which can compensate shear forces. The ribs connecting the outer skin and the inner geometry act like shock absorbers. The geometry of the ribs determines the degree of energy absorbed by the rib.

In an exemplary embodiment, a two-component pallet includes an upper part defining a deck and including a plurality of posts, and a lower part including a corresponding plurality of feet arranged in complement with the posts. Each of the posts includes a first alignment member and each of the feet includes a second alignment member, where the first and second alignment members are engageable with each other. Each of the posts includes a post perimeter and a plurality of post ribs extending between the post perimeter and the first alignment member, and each of the feet includes a foot perimeter and a plurality of foot ribs extending between the foot perimeter and the second alignment member. With the first alignment member engaged with the second alignment member, the post perimeter and the post ribs of the posts are oriented at least partly in complement with the foot perimeter and the foot ribs of the feet, respectively.

One of the first and second alignment members may include an anchor, and the other of the first and second alignment members may include a receiver, where the anchor may be received in the receiver. The first alignment member may include the anchor and the second alignment member may include the receiver, where the anchor extends outward beyond ends of the post perimeter and the post ribs. The anchors may include guides at distal ends thereof. The guides may include a tapered lead in. In some embodiments, the post ribs and the foot ribs are one of straight, curved or bent. In one embodiment, the post ribs and the foot ribs are no straight, i.e., curved or bent.

With the first alignment member engaged with the second alignment member, the post perimeter and the post ribs of the posts may be welded to the foot perimeter and the foot ribs of the feet, respectively. The lower part may include runners integral with and extending between the plurality of feet. At least one of the posts may include multiple first alignment members and a corresponding at least one of the feet may include a corresponding multiple second alignment members. The post ribs or the feet ribs each may include a step section adjacent the first alignment member or the second alignment member, respectively.

In another exemplary embodiment, a two-component pallet includes an upper part defining a deck and including a plurality of posts, and a lower part including a corresponding plurality of feet arranged in complement with the posts. The posts and the feet each include an alignment member and ribs, where the upper part is welded to the lower part such that the ribs are welded together. The alignment member of the posts may be engaged with the alignment member of the feet without being welded. The alignment member of the posts may include an anchor and the alignment member of the feet may include a receiver, where the anchor is received in the receiver.

In yet another exemplary embodiment, a method of manufacturing a two-component pallet includes the steps of engaging the alignment members of the posts with the alignment members of the feet, thereby aligning the ribs of the posts with the ribs of the feet; and welding the upper part to the lower part such that the ribs are welded together without welding the alignment members to one another. The engaging step may be practiced by inserting the alignment members of the posts into the alignment members of the feet.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
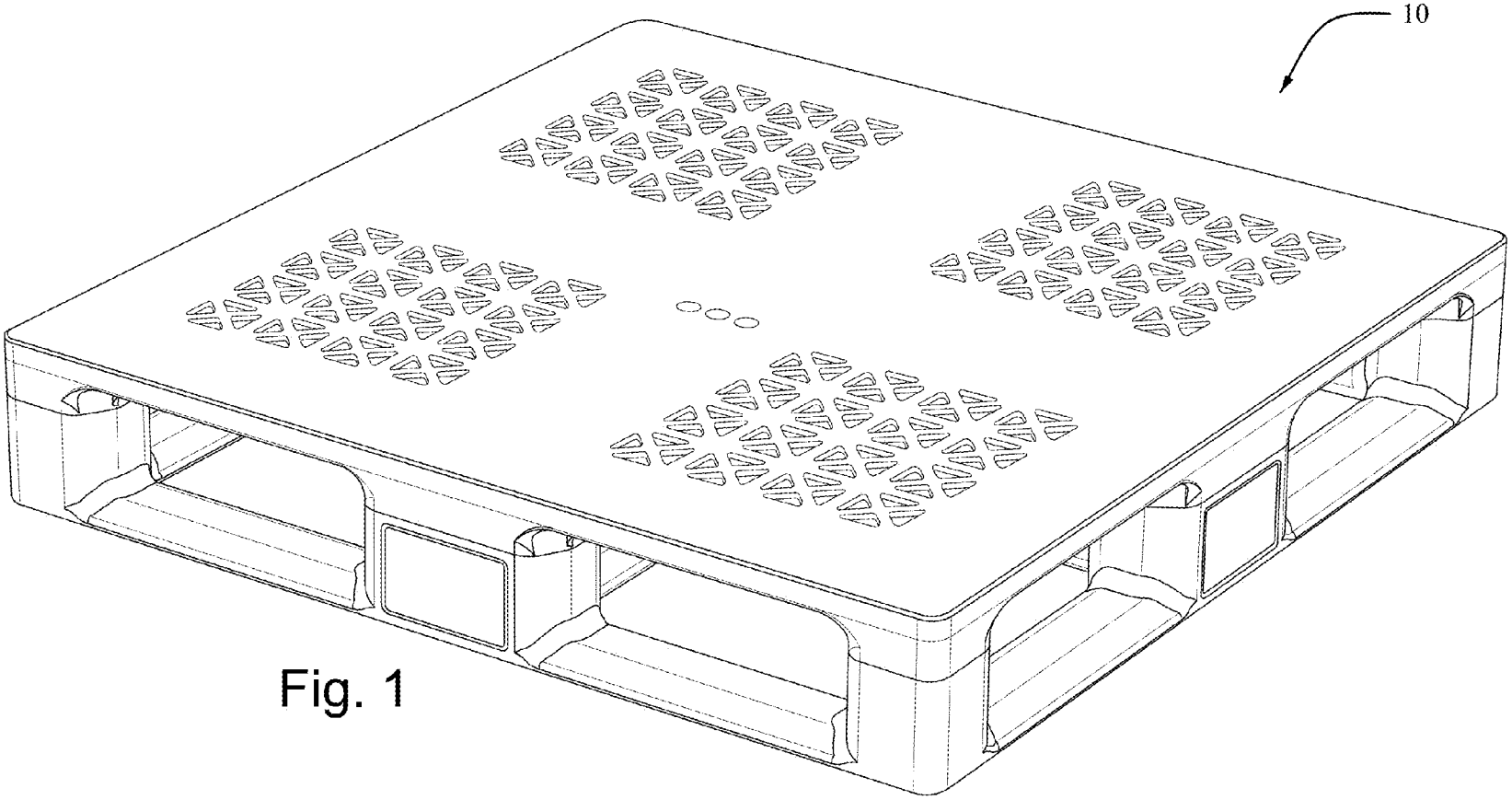
FIG. 1 is a perspective view of the assembled two-component pallet.
Figure 2:
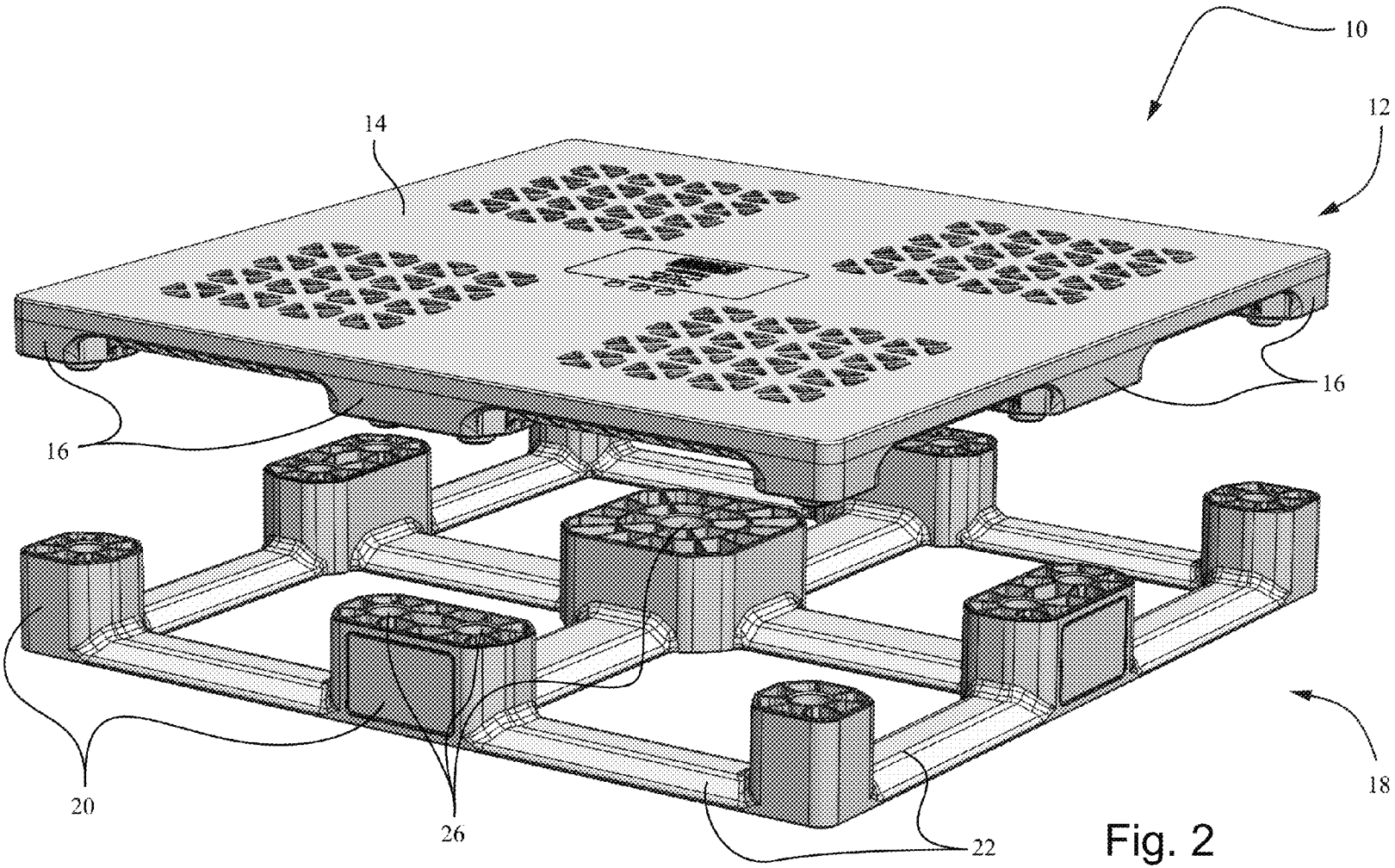
FIGS. 2-4 show various views of the two-component pallet before assembly.
Figure 3:
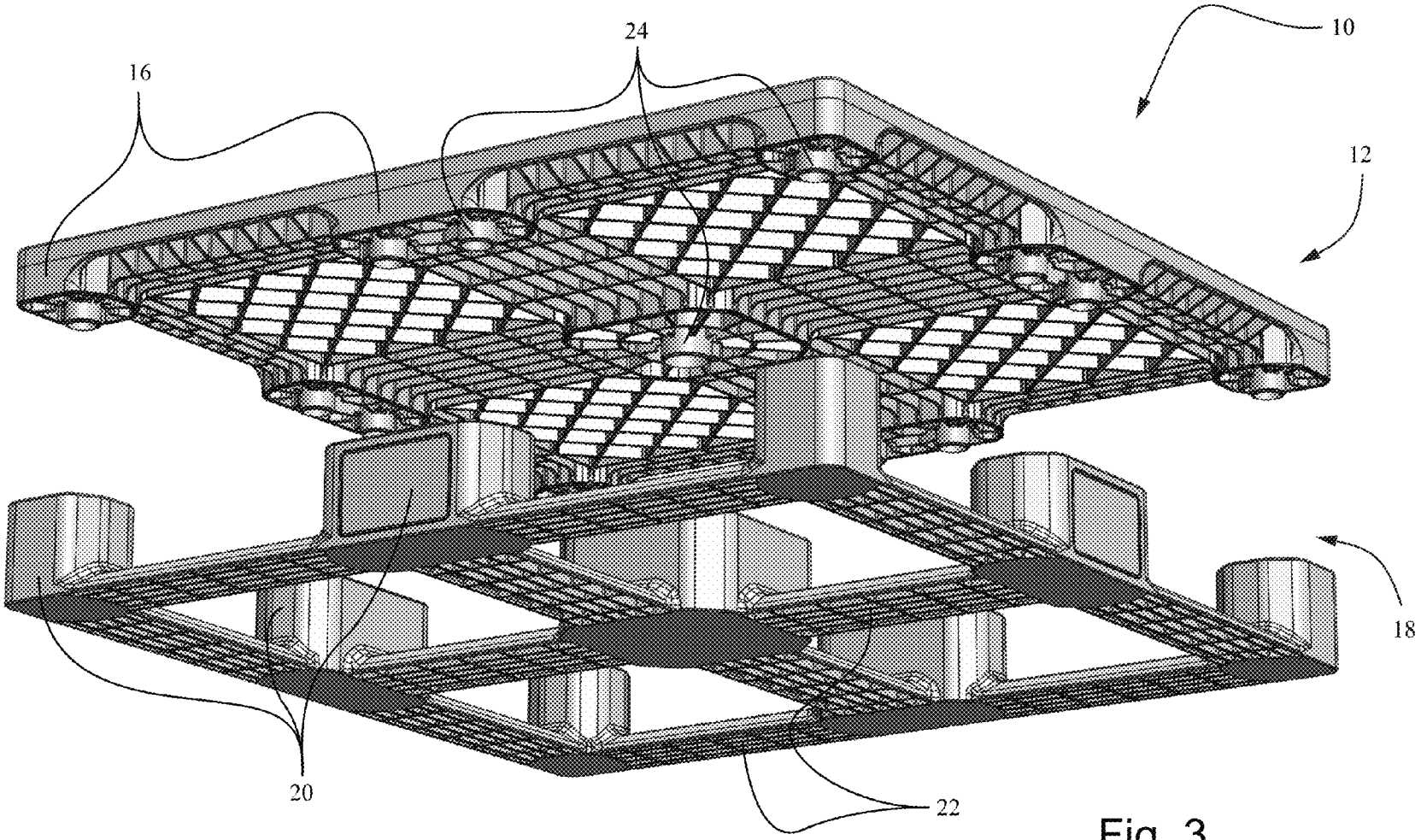
Figure 4:
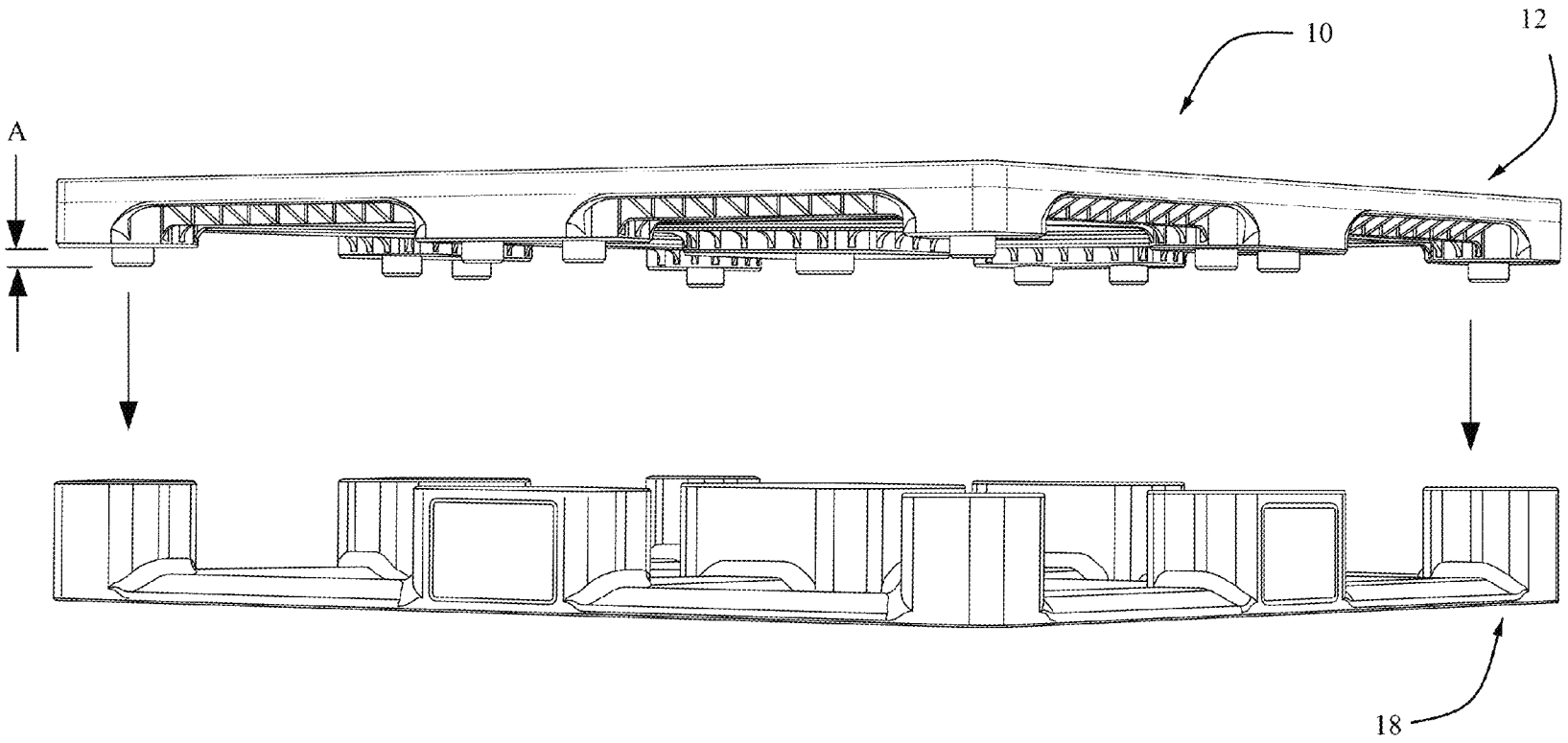

FIG. 1 is a perspective view of an assembled pallet 10. With reference to FIGS. 2-4, the two-component pallet 10 includes an upper part 12 defining a deck 14 and including a plurality of posts 16. A lower part 18 includes a corresponding plurality of feet 20 arranged in complement with the posts 16. That is, a post 16 is provided in the upper part 12 for each of the feet 20 provided in the lower part 18. In the exemplary embodiment shown in FIGS. 1-4, the upper part 12 is provided with nine posts 16, and the lower part 18 is provided with nine feet 20. A plurality of runners 22 are formed integral with and extend between the pluralities of feet 20.

Each of the posts 16 includes an alignment member such as an anchor 24 or the like, while each of the feet 20 similarly includes an alignment member such as an aperture or receiver 26 that is engageable with a corresponding anchor 24. The anchor 24 and receiver 26 construction is exemplary and other types of alignment structure could be utilized. As shown in FIGS. 3 and 4, each of the posts may include multiple alignment members 24, and each of the feet may similarly include multiple alignment members 26. Moreover, as shown, the anchors 24 and the receivers 26 are generally circular but could be formed into any shape—e.g., oval, square, etc. Moreover, although the anchors 24 are provided in the upper part 12, and the receivers 26 are provided in the lower part 18, the anchors and receivers could be reversed such that the receivers were formed in the upper part with the anchors formed in the lower part.

Figure 5:
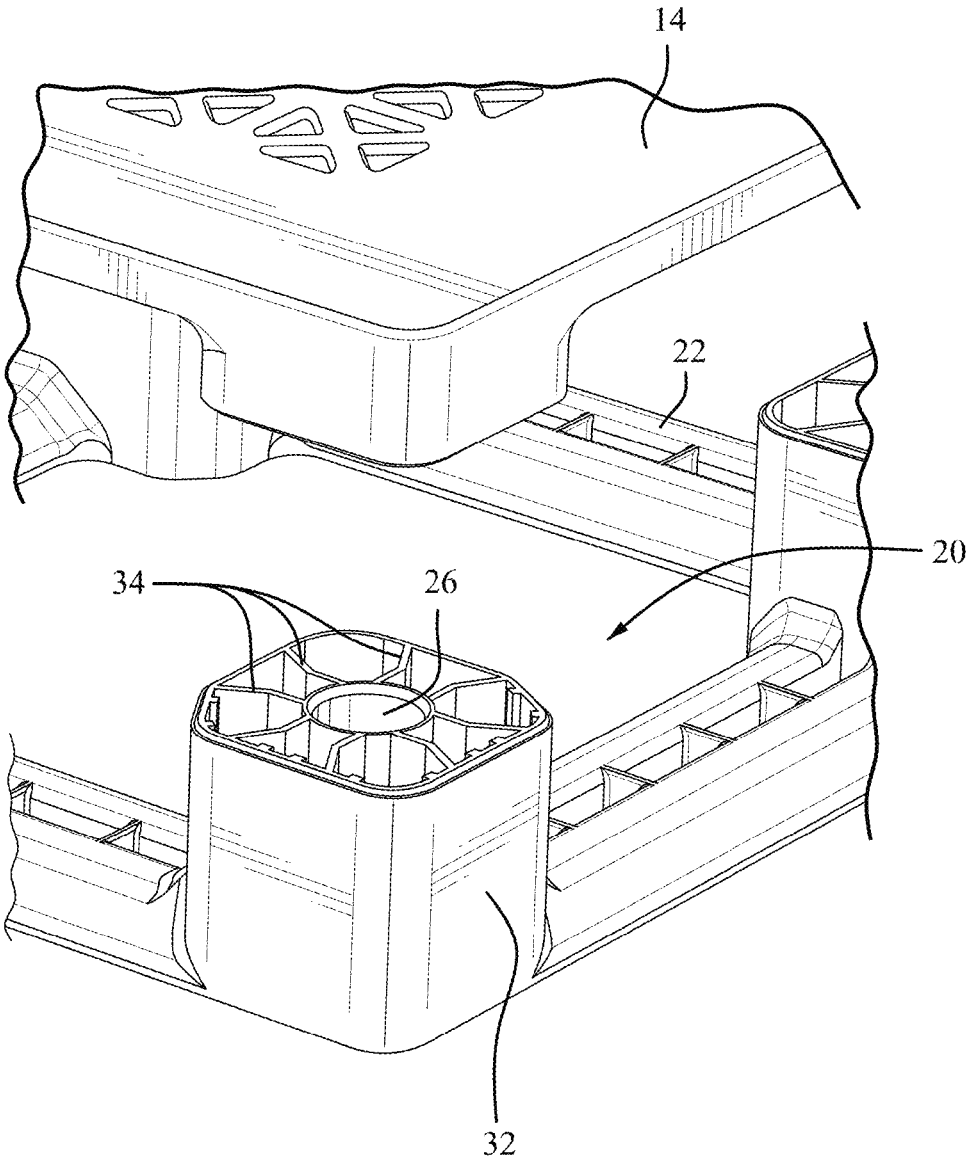
FIG. 5 is a close-up perspective view of one foot of the lower part.
Figure 6:
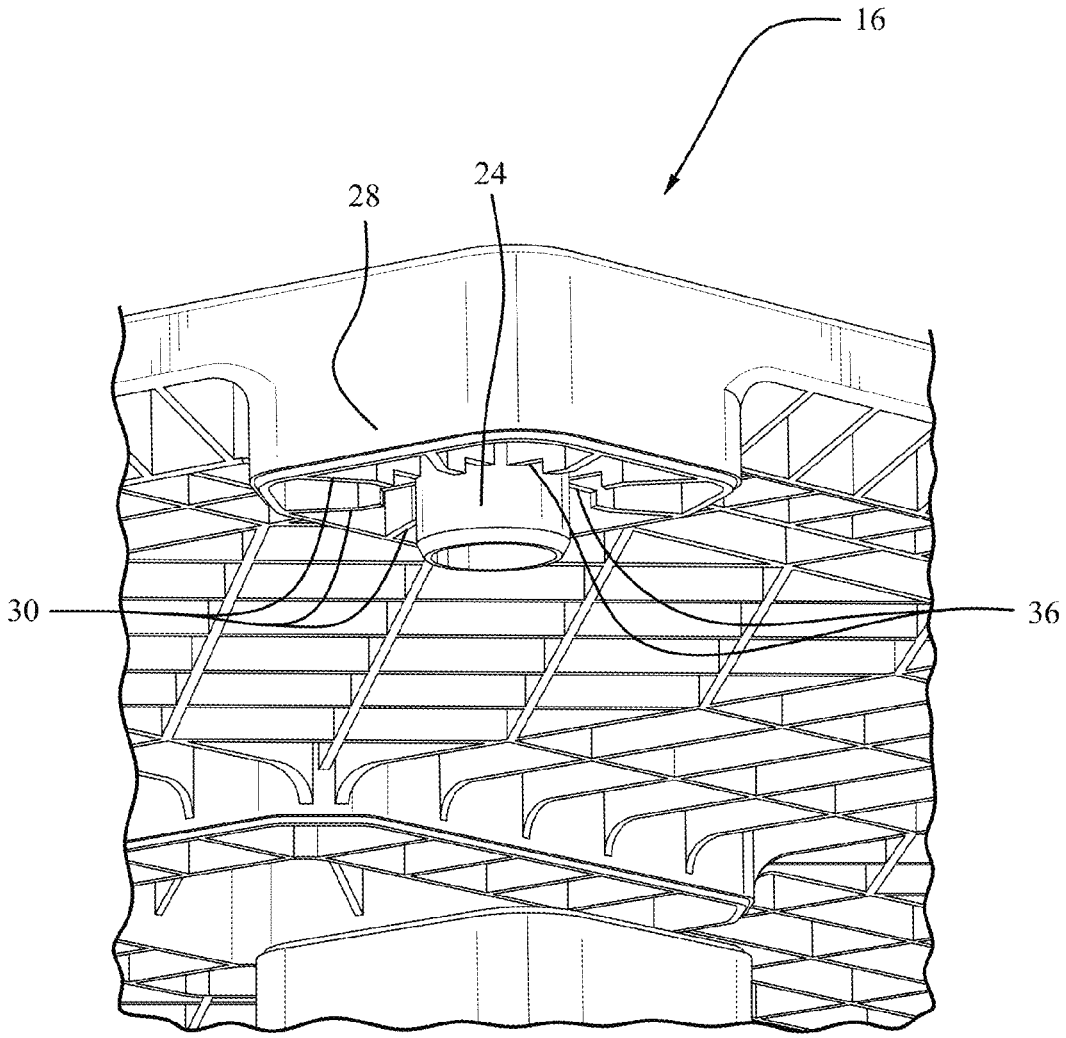
FIG. 6 is a close-up perspective view of one post of the upper part.

FIGS. 5 and 6 are close-up views of a foot 20 of the lower part and a post 16 of the upper part, respectively. Each post 16 is provided with a post perimeter 28 and a plurality of post ribs 30 extending between the post perimeter 28 and the alignment member such as anchor 24. Similarly, each of the feet includes a foot perimeter 32 and a plurality of foot ribs 34 extending between the foot perimeter 32 and the second alignment member such as receiver 26. With the first alignment member 24 engaged with the second alignment member 26, the post perimeter 28 and the post ribs 30 are oriented at least partly in complement with the foot perimeter 32 and the foot ribs 34, respectively. Preferably, the only part of the ribs 30, 34 that are not in direct alignment/engagement with the alignment members 24, 26 engaged is an area adjacent a step section 36 in the post ribs 30, shown adjacent the first alignment member 24 in FIG. 6. The step sections 36 may alternatively be formed in the foot ribs 34. The step sections 36 serve to relieve the geometry of the alignment members, e.g., the anchor 24. In the weld plate, the opening for the anchor, for example, may be approximately 6 mm larger, creating a 3 mm gap. The step section 36 may thus avoid an unmelted section of the rib, which could create weld problems. The step section 36 widens the production window (tolerance).

Figure 7:
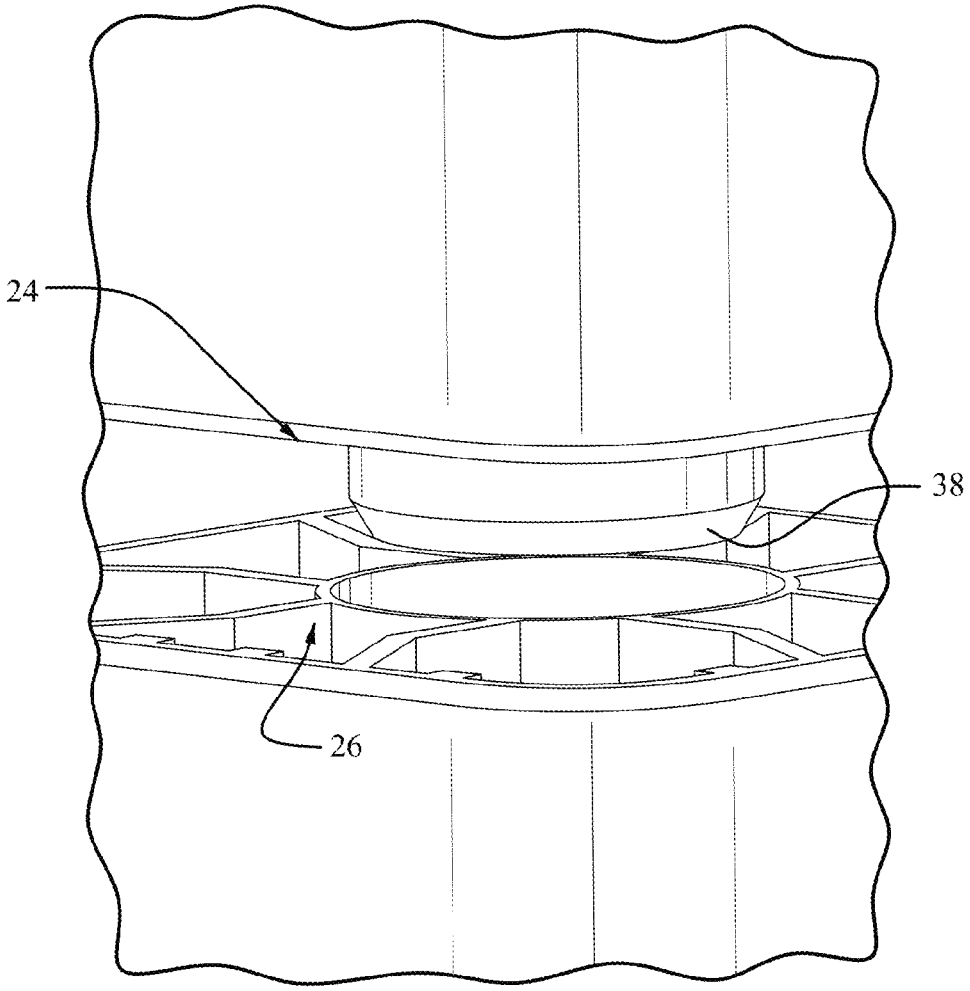
FIG. 7 is a close-up view of an exemplary alignment member.

FIG. 7 is a close-up view of an exemplary engagement between the first alignment member 24 and the second alignment member 26. In some embodiments, the first alignment member is an anchor 24 that extends outward beyond ends of the post perimeter 28 and the post ribs 30 (see FIG. 6 and distance A shown in FIG. 4). In the embodiment shown in FIG. 7, the anchor 24 is received in the receiver 26. In a preferred construction, the geometries fit into each other with zero play. The anchor 24 may be provided with a guide 38 to facilitate engagement with the receiver 26. In some embodiments, the guide 38 is a tapered end or tapered lead in of the anchor 24. With the anchors 24 engaging the receivers 26, the post perimeters 28 are aligned with the foot perimeters 32, and the post ribs 30 are aligned with the foot ribs 34.

Figure 8:
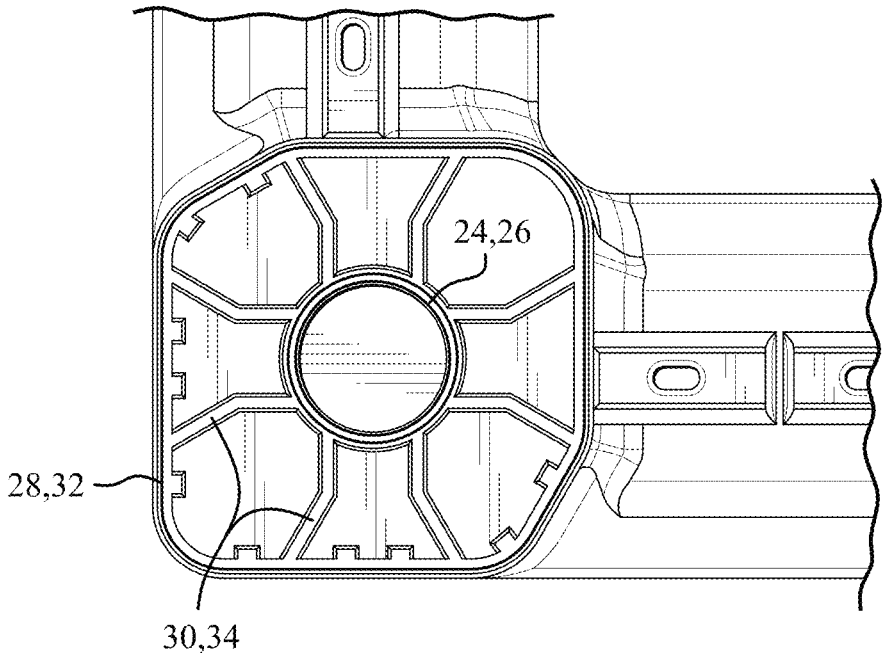
FIG. 8 is a plan view showing an exemplary arrangement of the ribs.

As shown in the drawings and with particular reference to FIG. 8, the ribs 30, 34 may be straight, curved or bent. In some embodiments, as shown in the drawings, the ribs 30, 34 are bent. In this manner, in the event of a side impact, the ribs 30, 34 would deform or deflect in a preset direction at a preset location, i.e., at the bend in the ribs 30, 34. The angle between the rib segments determines the amount of energy the ribs can absorb during an impact. With a straight rib, a deflection direction and location would be unpredictable, which may serve to reduce the useful life of the pallet. That is, the bent ribs 30, 34 enable the perimeters 28, 32 to deflect slightly, a so-called bumper effect, since a part of the side impact energy would be transferred/absorbed into the ribs 30, 34.

Figure 9:
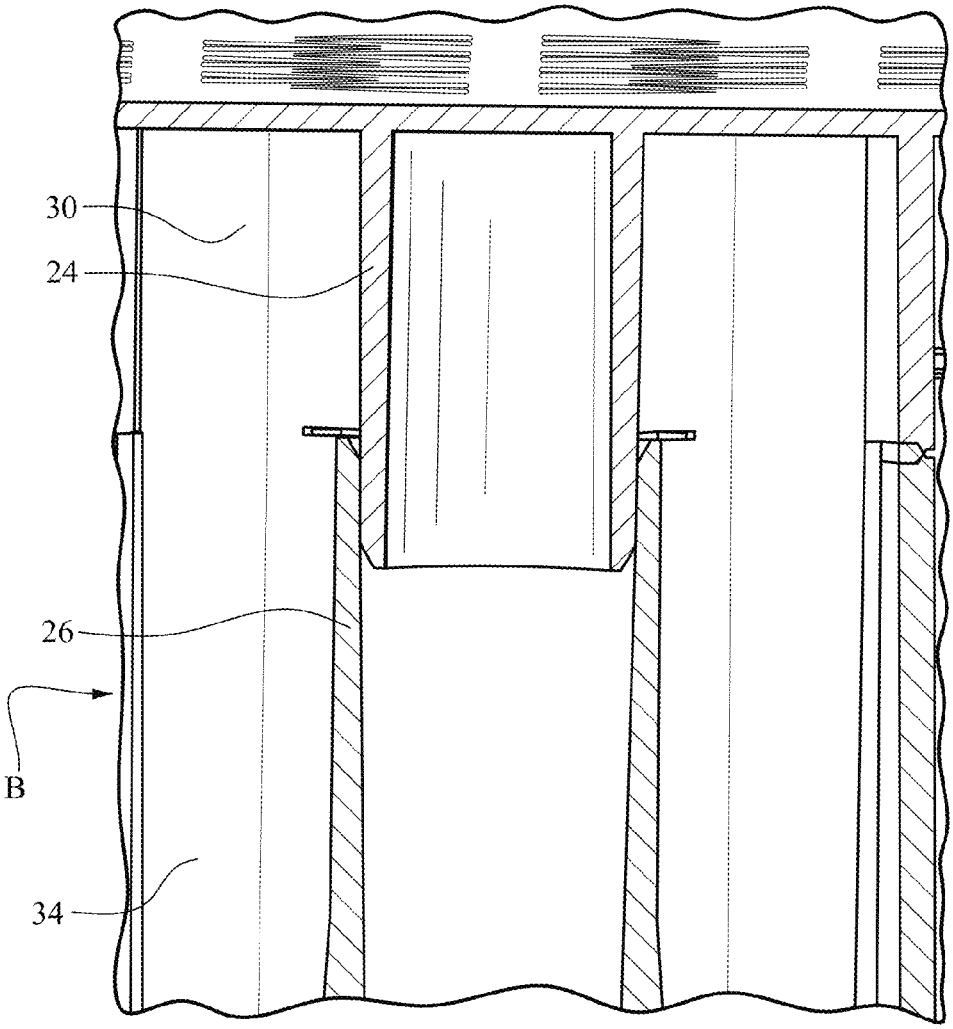
FIG. 9 is a section view through an assembled pallet.

In manufacturing the pallet, the upper part 12 and the lower part 18 are separately molded using known methods. The alignment members such as anchors 24 of the upper part 12 are engaged with the alignment members such as receivers 26 of the lower part 18. As shown in FIG. 9, in an exemplary construction, the anchors 24 are inserted into the receivers 26 in a tight (preferably zero play) fit. With the alignment members 24, 26 engaged, the perimeters 28, 32 and the ribs 30, 34 are properly aligned without any mismatch. The upper part 12 and the lower part 18 are subsequently welded via known hotplate welding or the like to permanently connect the perimeters 28, 32 and the ribs 30, 34. The alignment members 24, 26, however, remain engaged preferably without being welded.

The overlapping geometry of the exemplary alignment members 24, 26 creates a positive connection against shear. Additionally, the alignment members 24, 26 more accurately align the perimeters 28, 32 and the ribs 30, 34, which ensures the maximum strength of the welded ribs. Moreover, due to the bent ribs 30, 34 in some embodiments, a side impact (see arrow B in FIG. 9) from forklift tines or the like can be more easily absorbed, resulting in a longer useful life of the pallet. Deformation of the ribs in a predefined direction and at a predefined location provides for more efficient energy absorption.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A two-component pallet comprising:

an upper part defining a deck and including a plurality of posts; and a lower part including a corresponding plurality of feet arranged in complement with the posts, wherein each of the posts comprises a first alignment member and each of the feet comprises a second alignment member, the first and second alignment members being engageable with each other, wherein each of the posts comprises a post perimeter and a plurality of post ribs extending between the post perimeter and the first alignment member, wherein each of the feet comprises a foot perimeter and a plurality of foot ribs extending between the foot perimeter and the second alignment member, and wherein with the first alignment member engaged with the second alignment member, the post perimeter and the post ribs of the posts are oriented at least partly in facing alignment with the foot perimeter and the foot ribs of the feet, respectively.

2. A two-component pallet according to claim 1, wherein one of the first and second alignment members comprises an anchor and the other of the first and second alignment members comprises a receiver, and wherein the anchor is received in the receiver.

3. A two-component pallet according to claim 2, wherein the first alignment member comprises the anchor and the second alignment member comprises the receiver, and wherein the anchor extends outward beyond ends of the post perimeter and the post ribs.

4. A two-component pallet according to claim 2, wherein the anchors comprise guides at distal ends thereof.

5. A two-component pallet according to claim 4, wherein the guides comprise a tapered lead in.

6. A two-component pallet according to claim 1, wherein the post ribs and the foot ribs are one of straight, curved or bent.

7. A two-component pallet comprising:

an upper part defining a deck and including a plurality of posts; and a lower part including a corresponding plurality of feet arranged in complement with the posts, wherein each of the posts comprises a first alignment member and each of the feet comprises a second alignment member, the first and second alignment members being engageable with each other, wherein each of the posts comprises a post perimeter and a plurality of post ribs extending between the post perimeter and the first alignment member, wherein each of the feet comprises a foot perimeter and a plurality of foot ribs extending between the foot perimeter and the second alignment member, wherein with the first alignment member engaged with the second alignment member, the post perimeter and the post ribs of the posts are oriented at least partly in complement with the foot perimeter and the foot ribs of the feet, respectively, and wherein the post ribs and the foot ribs are curved or bent such that the post ribs and the foot ribs include straight sections on opposite sides of a bent section.

8. A two-component pallet according to claim 1, wherein with the first alignment member engaged with the second alignment member, the post perimeter and the post ribs of the posts are welded to the foot perimeter and the foot ribs of the feet, respectively.

9. A two-component pallet according to claim 1, wherein the lower part comprises runners integral with and extending between the plurality of feet.

10. A two-component pallet according to claim 1, wherein at least one of the posts comprises multiple first alignment members and a corresponding at least one of the feet comprises a corresponding multiple second alignment members.

11. A two-component pallet according to claim 1, wherein the post ribs or the feet ribs each comprise a step section adjacent and extending radially from the first alignment member or the second alignment member, respectively.

12. A two-component pallet comprising:

an upper part defining a deck and including a plurality of posts; and a lower part including a corresponding plurality of feet arranged in complement with the posts, wherein the posts and the feet each comprise an alignment member and ribs extending from the alignment member to a perimeter, wherein with the alignment members engaged with each other, the perimeters and the ribs of the posts and the feet are oriented at least partly in facing alignment, wherein the upper part is welded to the lower part such that the ribs are welded together, and wherein the alignment member of the posts is engaged with the alignment member of the feet without being welded.

13. A two-component pallet according to claim 12, wherein each of the posts and the feet comprise a perimeter, and wherein the perimeters of the posts are welded to the perimeters of the feet, wherein the ribs extend from the perimeter to the alignment member.

14. A two-component pallet according to claim 13, wherein the ribs are curved or bent.

15. A two-component pallet according to claim 12, wherein the alignment member of the posts comprises an anchor and the alignment member of the feet comprises a receiver, and wherein the anchor is received in the receiver.

16. A method of manufacturing a two-component pallet including an upper part defining a deck and having a plurality of posts, and a lower part including a corresponding plurality of feet arranged in complement with the posts, wherein the posts and the feet each have an alignment member and ribs extending from the alignment member to a perimeter, the method comprising:

engaging the alignment members of the posts with the alignment members of the feet, thereby aligning the ribs and the perimeter of the posts with the ribs and the perimeter of the feet such that the ribs and the perimeter of the posts are in facing contact with the ribs and the perimeter of the feet; and welding the upper part to the lower part such that the ribs and the perimeters are welded together without welding the alignment members to one another.

17. A method according to claim 16, wherein the engaging step is practiced by inserting the alignment members of the posts into the alignment members of the feet.

* * * * *